US008098202B2

(12) United States Patent
Annamaa et al.

(10) Patent No.: US 8,098,202 B2
(45) Date of Patent: Jan. 17, 2012

(54) DUAL ANTENNA AND METHODS

(75) Inventors: Petteri Annamaa, Oulunsalo (FI); Pertti Nissinen, Kempele (FI)

(73) Assignee: Pulse Finland Oy (FI)

( * ) Notice: Subject to any disclaimer, the term of this patent is extended or adjusted under 35 U.S.C. 154(b) by 199 days.

(21) Appl. No.: 12/227,746

(22) PCT Filed: May 8, 2007

(86) PCT No.: PCT/FI2007/050256

§ 371 (c)(1),
(2), (4) Date: May 19, 2009

(87) PCT Pub. No.: WO2007/138157

PCT Pub. Date: Dec. 6, 2007

(65) Prior Publication Data

US 2009/0231201 A1 Sep. 17, 2009

(30) Foreign Application Priority Data

May 26, 2006 (FI) ..... 20065357

(51) Int. Cl.
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS 6,100,849 A 8/2000 Tsubaki et al.
6,133,879 A 10/2000 Grangeat et al.
6,147,650 A 11/2000 Kawahata et al.
6,177,908 B1 1/2001 Kawahata et al.
6,456,249 B1 9/2002 Johnson et al.
6,738,022 B2 5/2004 Klaavo et al.
6,903,692 B2 6/2005 Kivekas et al.
7,136,020 B2 * 11/2006 Yamaki ..... 343/702
7,345,634 B2 3/2008 Ozkar et al.
7,352,326 B2 4/2008 Korva et al.

(Continued)

FOREIGN PATENT DOCUMENTS

EP 0 332 139 9/1989

(Continued)

OTHER PUBLICATIONS

Wong, K., et al.; "A Low-Profile Planar Monopole Antenna for Multiband Operation of Mobile Handsets"; IEEE Transactions on Antennas and Propagation, Jan. 2003, vol. 51, No. 1.

(Continued)

*Primary Examiner* — Tan Ho

(74) *Attorney, Agent, or Firm* — Gazdzinski & Associates, PC

(57) ABSTRACT

A dielectric dual antenna (300) intended especially for small-sized radio apparatuses, with one partial antenna (310) of which is implemented the lower operating band of the antenna and with the second partial antenna (320) the upper operating band. The partial antennas have a shared feed point (FP) in the antenna structure, e.g. at the end of a radiating element (312) of one partial antenna, in which case the other partial antenna receives its feed galvanically through said radiating element by a short intermediate conductor (332). The partial antennas are located so that their substrates (311, 321) are heads face to face, and the main directions of the radiating elements i.e. the conductive coatings of the substrates starting from the shared feed point are opposing. The tunings of the partial antennas corresponding to different operating bands are obtained independent from each other without discrete matching components.

28 Claims, 4 Drawing Sheets

U.S. PATENT DOCUMENTS

| | | | | |
|---|---|---|---|---|
| 7,358,902 | B2 | 4/2008 | Erkocevic et al. | |
| 7,466,277 | B2 * | 12/2008 | Ishizuka et al. | 343/702 |
| 7,468,700 | B2 | 12/2008 | Milosavlejevic et al. | |
| 7,589,678 | B2 | 9/2009 | Perunka et al. | |
| 7,663,551 | B2 | 2/2010 | Nissinen et al. | |
| 7,679,565 | B2 | 3/2010 | Sorvala | |
| 2002/0145569 | A1 | 10/2002 | Onaka et al. | |
| 2002/0196192 | A1 | 12/2002 | Nagumo et al. | |
| 2003/0006936 | A1 | 1/2003 | Aoyama et al. | |
| 2003/0020659 | A1 | 1/2003 | Kushihi et al. | |
| 2004/0032371 | A1 * | 2/2004 | Mendolia et al. | 343/702 |
| 2004/0085244 | A1 | 5/2004 | Kadambi et al. | |
| 2005/0024272 | A1 | 2/2005 | Ponce De Leon et al. | |
| 2005/0057401 | A1 | 3/2005 | Yuanzhu et al. | |
| 2005/0057416 | A1 | 3/2005 | Yuanzhu et al. | |
| 2005/0078037 | A1 | 4/2005 | Leclerc et al. | |
| 2005/0099347 | A1 | 5/2005 | Yamaki et al. | |
| 2005/0176481 | A1 | 8/2005 | Jeong | |
| 2006/0071857 | A1 | 4/2006 | Pelzer | |
| 2006/0145924 | A1 | 7/2006 | Chen et al. | |
| 2007/0013589 | A1 | 1/2007 | Park et al. | |

FOREIGN PATENT DOCUMENTS

| | | | |
|---|---|---|---|
| EP | 1 294 048 | | 1/1999 |
| EP | 1 063 722 | A2 | 12/2000 |
| EP | 1 544 943 | | 6/2005 |
| EP | 1 791 213 | | 5/2007 |
| JP | 03 280625 | | 12/1991 |
| JP | 2001217631 | | 10/2001 |
| JP | 2002319811 | A | 10/2002 |
| JP | 2004363859 | | 12/2004 |
| JP | 2005252661 | | 9/2005 |
| WO | WO 98/01921 | | 1/1998 |
| WO | WO 01/28035 | | 4/2001 |
| WO | WO 2004/070872 | | 8/2001 |
| WO | WO 02/078123 | | 10/2002 |
| WO | WO 2004070872 | A1 | 8/2004 |
| WO | WO 2004/112189 | A | 12/2004 |
| WO | WO 2005/018045 | | 2/2005 |
| WO | WO 2005/038981 | A1 | 4/2005 |
| WO | WO 2005/055364 | | 6/2005 |
| WO | WO 2006/000631 | A1 | 1/2006 |
| WO | WO 2006/000650 | | 1/2006 |
| WO | WO 2006000631 | A1 | 1/2006 |
| WO | WO 2006/051160 | A1 | 5/2006 |
| WO | WO 2006051160 | A1 | 5/2006 |
| WO | WO 2006/084951 | A1 | 8/2006 |
| WO | WO 2006/097567 | | 9/2006 |
| WO | WO 2007/000483 | A1 | 1/2007 |
| WO | WO 2007/039667 | | 4/2007 |
| WO | WO 2007/042615 | | 4/2007 |
| WO | WO 2007/080214 | | 7/2007 |

OTHER PUBLICATIONS

Jing, X., et al.; "Compact Planar Monopole Antenna for Multi-Band Mobile Phones"; Microwave Conference Proceedings, Dec. 4-7, 2005.APMC 2005, Asia-Pacific Conference Proceedings, vol. 4.

Wang, H.; "Dual-Resonance Monopole Antenna with Tuning Stubs"; IEEE Proceedings, Microwaves, Antennas & Propagation, vol. 153, No. 4, Aug. 2006; pp. 395-399.

* cited by examiner

DUAL ANTENNA AND METHODS

PRIORITY AND RELATED APPLICATIONS

This application claims priority to International PCT Application No. PCT/FI2007/050256 entitled "Dual antenna" having an international filing date of May 8, 2007, which claims priority to Finland Patent Application No. 20065357 of the same title filed May 26, 2006, each of the foregoing incorporated herein by reference in its entirety. This application is related to co-owned and co-pending U.S. patent application Ser. No. 12/083,129 filed Apr. 3, 2008 entitled "Multiband Antenna System And Methods", Ser. No. 12/080,741 filed Apr. 3, 2008 entitled "Multiband Antenna System and Methods", Ser. No. 12/082,514 filed Apr. 10, 2008 entitled "Internal Antenna and Methods", Ser. No. 12/009,009 filed Jan. 15, 2008 and entitled "Dual Antenna Apparatus And Methods", Ser. No. 11/544,173 filed Oct. 5, 2006 and entitled "Multi-Band Antenna With a Common Resonant Feed Structure and Methods", and co-owned and co-pending U.S. patent application Ser. No. 11/603,511 filed Nov. 22, 2006 and entitled "Multiband Antenna Apparatus and Methods", each also incorporated herein by reference in its entirety. This application is also related to co-owned and co-pending U.S. patent application Ser. No. 11/648,429 filed Dec. 28, 2006 and entitled "Antenna, Component And Methods", and Ser. No. 11/648,431 also filed Dec. 28, 2006and entitled "Chip Antenna Apparatus and Methods", both of which are incorporated herein by reference in their entirety. This application is further related to U.S. patent application Ser. No. 11/901,611 filed Sep. 17, 2007 entitled "Antenna Component and Methods", Ser. No. 11/883,945 filed Aug. 6, 2007entitled "Internal Monopole Antenna", Ser. No. 11/801,894 filed May 10, 2007 entitled "Antenna Component", and Ser. No. 11/922,976 entitled "Internal multiband antenna and methods" filed Dec. 28, 2007, each of the foregoing incorporated by reference herein in its entirety. This application is further related to U.S. patent application Ser. No. 12/082,882 filed Apr. 14, 2008 entitled "Adjustable Antenna and Methods", and Ser. No. 12/217,789 filed Jul. 8, 2008 entitled "RFID Antenna and Methods".

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

The invention relates to an antenna structure of a small-sized radio apparatus which structure comprises two electrically relatively separate parts.

In small-sized portable radio apparatuses, such as mobile phones, the antenna is placed for convenience of use preferably inside the covers of the apparatus. Furthermore, as one tries to make the antenna to consume as small a space as possible, its design becomes demanding. Additional difficulties in design are caused if the radio apparatus has to operate in several frequency ranges, the more the broader these ranges are.

Internal antennas are mostly plane-structured, whereby they have a radiating plane and a ground plane at a certain distance from it. A planar antenna can be made smaller by manufacturing the radiating plane on the surface of a dielectric substrate instead of it being air-insulated. Naturally, the higher the permittivity of the material, the smaller physically the antenna element having a certain electric size is. By using e.g. ceramics having a high dielectric constant as the substrate, the antenna component becomes a chip to be mounted on a circuit board. FIG. 1 shows an example of a dielectric antenna, or an antenna based on such a chip component. A portion of the circuit board PCB of a radio apparatus is seen in the figure. On the circuit board there is an antenna component 110 which comprises a dielectric substrate 111 and, on the surface of this, two antenna elements. The first antenna element 112 covers one portion of the top surface of the substrate and its one head surface. The second antenna element 113 covers another portion of the top surface of the substrate and its other, opposing head surface. The antenna elements extend a bit on the side of the bottom surface of the substrate for constituting contact surfaces. In the middle of the top surface between the elements, there is a slot SL which extends in the cross direction from one side surface of the substrate to another. The feed conductor 130 of the antenna is a strip conductor on the top surface of the circuit board, and it constitutes together with the ground plane, or the signal ground GND, and the circuit board material a feed line having a specified impedance. The feed conductor 130 connects galvanically to the first antenna element 112 on its contact surface. From its second contact surface, the first antenna element connects galvanically to the ground plane GND. At the opposing end of the substrate, the second antenna element 113 connects galvanically from its contact surface to the ground plane GND. The second antenna element only receives its feed electromagnetically over said slot SL, in which case it is a parasitic element.

The entire antenna consists of the antenna component 110 and the ground plane. In the example of FIG. 1, there is no ground plane below the antenna component, and beside of the component the ground plane is at a certain distance from it. This distance and the width and length of the portion of the ground plane extending to the parasitic element 113 affect the natural frequency and the impedance of the entire antenna, for which reason the antenna can be tuned and matched by optimising them. The antenna elements radiate at least almost at the same frequency, the antenna thus being a one-band antenna.

A common way of realising a two- or multi-band antenna is to divide the radiating element to at least two branches of different lengths seen from the shorting point of the element. In this way, it is relatively easy to obtain a satisfying result in air-insulated planar antennas. Instead, when using a very small-sized chip component, it is difficult to obtain reasonable matching with e.g. two operating bands. Furthermore, isolation between the antenna components corresponding to different bands remains inadequate.

FIG. 2 shows a known dielectric antenna in which some afore-mentioned disadvantages are eliminated. The structure is a dual antenna; it includes two antenna components with a ceramic substrate on a circuit board PCB and the partial antennas corresponding them. The antenna structure has a lower and an upper resonance, and it has correspondingly two bands: the lower operating band is constituted by the first antenna component 210, and the upper operating band by the second antenna component 220. Because of the separateness of the components, also their electromagnetic near fields are separate, and the isolation between the partial antennas is good in this relation. The partial antennas have a shared feed conductor 231 connected to the antenna port AP, which feed conductor branches to feed conductors leading to the antenna components. If these feed conductor branches were connected directly to the radiators, the partial antennas would adversely affect each other via their shared feed so that the tuning of one would change the tuning of the other. Furthermore, the upper resonance would easily become weak or it would not excite at all. For this reason, the structure requires matching components. In the example of FIG. 2, in series with the feed conductor of the first antenna component 210 are a coil L1 and a capacitor C1. The natural frequency of the resonance circuit constituted by these is the same as the centre frequency of the lower operating band. In series with the feed conductor of the second antenna component 220 is a capacitor C2, and between its end on the side of the antenna component and the ground plane GND is a coil L2. The cut-off frequency of a high-pass filter constituted by the capacitor C2 and the coil L2 is somewhat below the upper operating band.

A disadvantage of the solution according to FIG. 2 and similar other arrangements is the space required by the matching components on the circuit board and additional costs in production incurred by them. It is conceivable that the required matching is made without separate components with conductor patterns on the surface of the circuit board, but in any case all these patterns would require a relatively large area on the circuit board.

In a first aspect of the invention, a dielectric antenna comprising a dual antenna is disclosed. In one embodiment, the dual antenna comprises one partial antenna of which is implemented the lower operating band of the antenna and with the other partial antenna the upper operating band. The partial antennas have a shared feed point in the antenna structure, e.g. at an end of a radiating element of one partial antenna, in which case the other partial antenna receives its feed galvanically through said radiating element by a short intermediate conductor. The partial antennas are located so that their substrates are heads face to face, and the main directions of the radiating elements i.e. the conductive coatings of the substrates starting from the shared feed point are opposing.

An advantage of this exemplary embodiment of the invention is that the tunings of partial antennas corresponding to the different operating bands are obtained independent from each other without discrete matching components, even though they have a shared feed point. Related to foregoing, an advantage of this exemplary embodiment of the invention is that the space required for the antenna structure is very small. A further advantage of this exemplary embodiment of the invention is that the efficiency of the antenna is good for a dielectric antenna.

In a second aspect of the invention, a dual antenna is disclosed. In one embodiment, the dual antenna comprises a radiating element disposed on a first portion of a first substrate; a radiating element disposed on a second portion of a second substrate; a feed point common to both the first and second radiating elements; and an intermediate conductor disposed between the first radiating element and the second radiating element.

In one variant, the feed point common to both the first and second radiating elements is in the first radiating element.

In another variant, the first substrate and the second substrate are substantially detached from one another.

In still another variant, the first and second substrates are part of a unitary substrate, and at least a portion of the material of the unitary substrate has been removed between the first and second radiating elements to provide at least some electrical isolation.

In yet another variant, the intermediate conductor comprises a conductive coating on a surface of the substrate, the intermediate conductor extending from the first radiating element to the second radiating element.

In still another variant, the intermediate conductor comprises a conductive coating disposed on an inner surface of a hole formed in the substrate, the conductive coating extending from the first radiating element to the second radiating element.

In still yet another variant, the substrate comprises a ceramic material.

In a second embodiment, the dual antenna comprises a first partial antenna to implement a lower operating band of the antenna; and a second partial antenna to implement an upper operating band; wherein both partial antennas comprise a respective dielectric substrate and as its conductive coating at least one radiating element, wherein both substrates have a first and a second head, a top, a bottom and a plurality of side surfaces the direction of the plurality of side surfaces normal of the heads being the longitudinal direction of the substrate. The substrates of the partial antennas are located their first heads face to face, they have substantially the same longitudinal direction, and the partial antennas have a shared feed point in a coupling space defined by the first heads at the end of the radiating element on the side of the first head of the substrate of one partial antenna. The other partial antenna gets its feed through an intermediate conductor which extends in the coupling space from last-mentioned radiating element to a radiating element of the latter partial antenna.

In one variant, the shared feed point is in a radiating element of the first partial antenna.

In another variant, the substrate of the first partial antenna and the substrate of the second partial antenna are detached, and the intermediate conductor is a separate conductor connected to a radiator of the first partial antenna and a radiator of the second partial antenna.

In another variant, the substrate of the first partial antenna and the substrate of the second partial antenna constitute a unitary total substrate, where substrate material has been reduced between the partial antennas for improving their electrical isolation.

In still another variant, the intermediate conductor is a conductive coating on inner surface of the type of hole, the coating extending from the radiator of the first partial antenna to the radiator of the second partial antenna.

In yet another variant the substrate material has been reduced so that at least one hole leads through the substrate.

In another variant, the substrate material has been reduced so that there is at least one groove in the substrate.

In still yet another variant, the intermediate conductor is a conductive coating on a side surface of the substrate extending from a radiator of the first partial antenna to a radiator of the second partial antenna.

In another variant, the first partial antenna comprises a first radiating element which covers one part of the top surface of its substrate and at least a part of the first head of its substrate, and a second radiating element which covers another part of the top surface of the substrate in question and at least a part of the other head of the substrate. The radiating elements extend via the heads of the substrate on the side of the bottom surface of the substrate to form the feed point and a ground point to the first radiating element and to form at least one ground point to the second radiating element.

In yet another variant, the substrates comprise a ceramic material.

In a third embodiment, the dual antenna comprises an independently-tunable dual antenna, the antenna being disposed on an external substrate and comprising: a first radiating element disposed on a first substrate; a second radiating element disposed on a second substrate; a feed point common to both the first and second radiating elements; an intermediate conductor disposed between the first radiating element and the second radiating element; and a conductive trace on the external substrate electrically coupled with the feed point. The independent tuning is provided at least in part by way of the intermediate conductor and without the use of discrete matching components.

In a third aspect of the invention a method of operating a dual antenna is disclosed. In one embodiment, the dual antenna is capable of operating in first and second frequency bands and the antenna comprises a first radiating element disposed on a first substrate, a second radiating element disposed on a second substrate, a feed point common to both the first and second radiating elements; and an intermediate conductor disposed between the first radiating element and the second radiating element, the dual antenna being disposed on an external substrate different from the first or second substrates. The method comprises placing a conductive trace on the external substrate in signal communication with the feed point of the dual antenna; and operating the dual antenna within the first and second bands.

In one variant, the method further comprises tuning the first and second radiating elements substantially independent of one another.

In another variant, the substantially independent tuning of the first and second radiating elements is provided at least in part by the intermediate conductor.

In still another variant, the method further comprises providing electrical isolation between the first and second radiating elements, the isolation provided at least in part by use of the first substrate and the second substrate, the first and second substrates being substantially detached from one another.

In another variant, the method further comprises providing electrical isolation between the first and second radiating elements, the isolation provided at least in part by the first and second substrates, the first and second substrates comprise a unitary substrate having material removed at least partly between the first and second radiating elements, the removed material enhancing the electrical isolation between the first and second radiating elements.

BRIEF DESCRIPTION OF THE DRAWINGS

The invention will now be described in detail. The description refers to the accompanying drawings in which.

DETAILED DESCRIPTION OF THE INVENTION

Reference is now made to the drawings wherein like numerals refer to like parts throughout.

Figure 1:
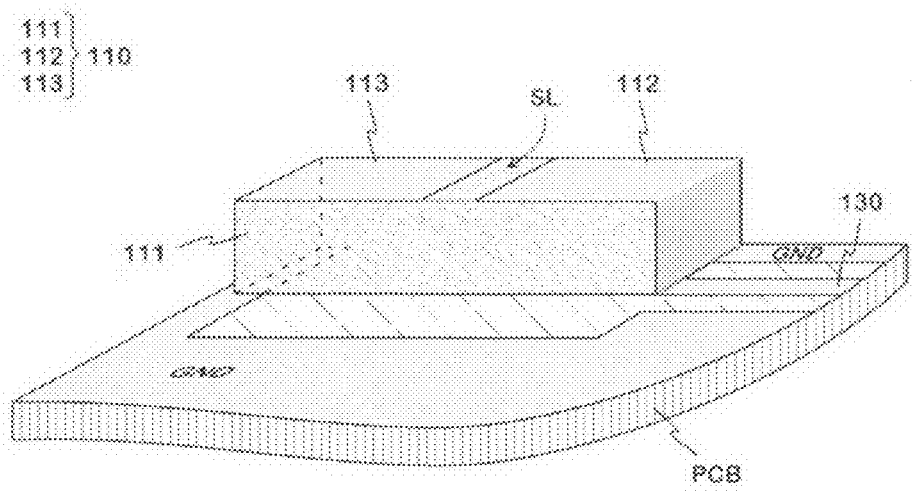
Fig. 1 PRIOR ART
FIG. 1 shows an example of a known dielectric antenna.
Figure 2:
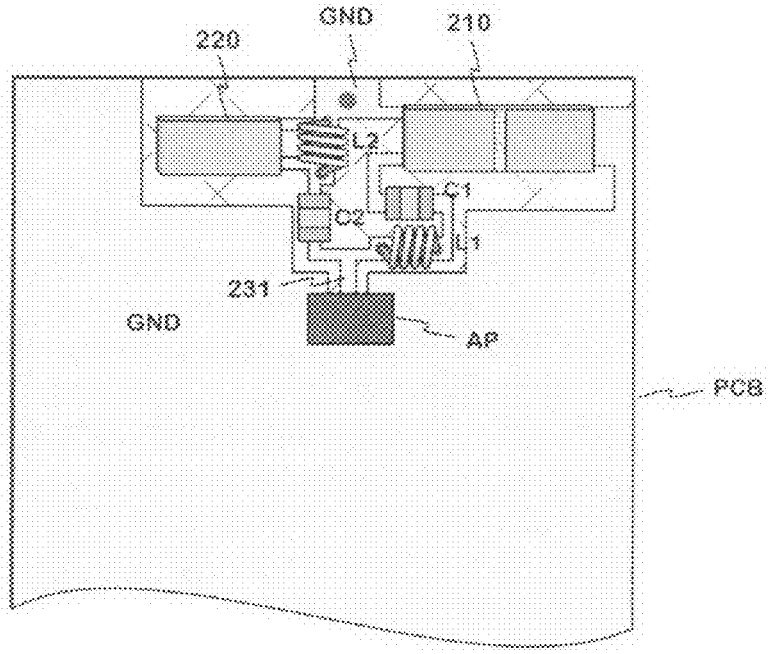
Fig. 2 PRIOR ART
FIG. 2 shows an example of a known dielectric dual antenna.

FIGS. 1 and 2 were already described in connection with the description of prior art.

Figure 3:
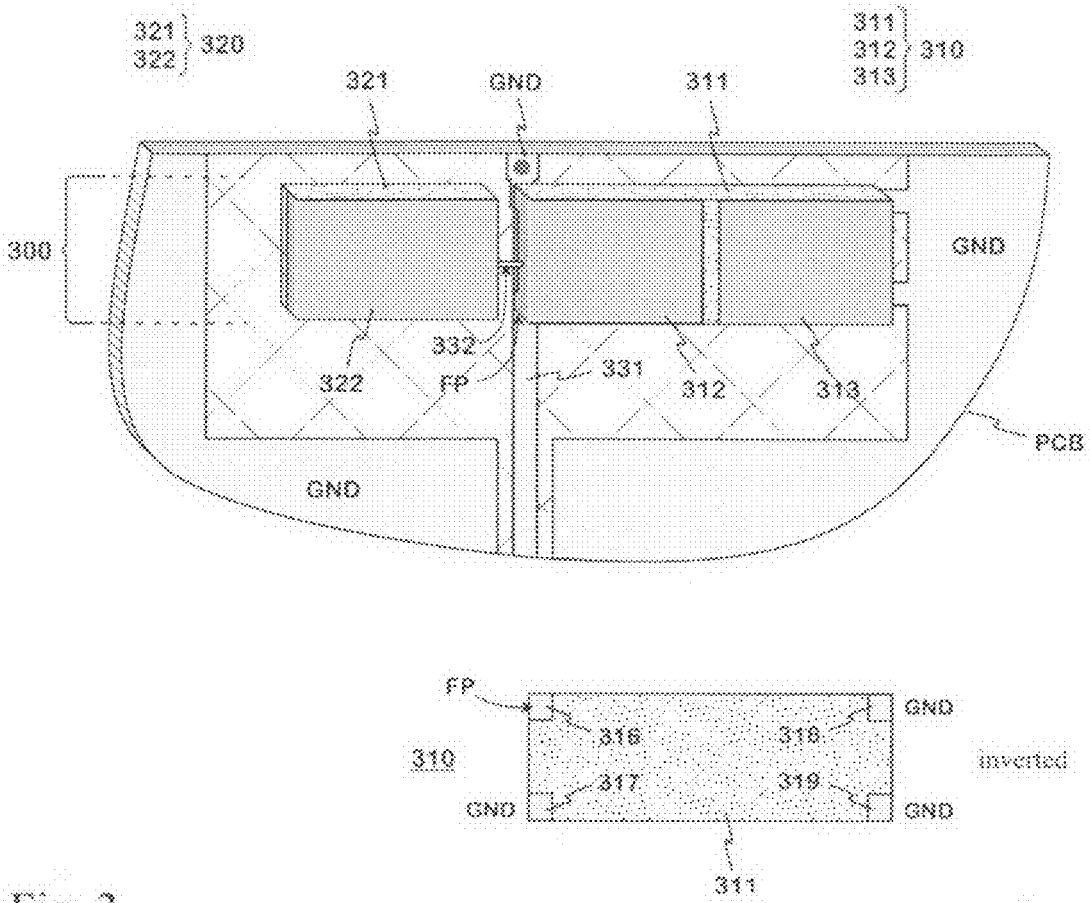
FIG. 3 shows an example of a dielectric dual antenna according to the invention.

FIG. 3 shows an example of a dielectric dual antenna according to the invention. A portion of the circuit board PCB of a radio apparatus is seen in the drawing. On the circuit board there are two antenna components 310 and 320, as in FIG. 2. These components will be called "partial antennas". Both partial antennas comprise a dielectric substrate which has heads, top and bottom surfaces and side surfaces. The substrates are located heads face to face relatively close to each other and they have the same longitudinal direction, when this means the direction of the normal of the heads. The face-to-face located heads of the substrates will be called first heads. The first partial antenna 310 further comprises on the surface of its substrate 311 in this example two radiating elements: the first radiating element 312 covers one portion of the top surface of the substrate 311 and its first head at least partially, and the second radiating element 313 covers another portion of the top surface of the substrate 311 and its second head at least partially. The radiating elements extend via the heads a bit to the side of the bottom surface of the substrate in the corners of the bottom surface for constituting the contact surfaces. The first radiating element is connected from its first contact surface 316 to the feed conductor 331 of the antenna and from the second contact surface to the ground GND. The second radiating element 313 is parasitic being connected from its both contact surfaces 318, 319 to the ground GND. The parts of the antenna corresponding to the first and the second radiating element have the same resonance frequency. The second partial antenna 320 further comprises on the surface of its substrate 321 in this example one radiating element. This element, or the third radiating element 322, covers at least partially the top surface of the second substrate 321 and both its first and second head.

Because of the mutual position of the substrates, the main direction of the radiating elements of the first partial antenna and the main direction of the radiating element of the second partial antenna are opposing seen from the shared feed point.

The feed conductor 331 of the antenna is a conductor strip on the top surface of the circuit board PCB. The feed conductor 331 extends below the first partial antenna 310 at the end on the side of the first head of the first substrate 311 and is connected as described above to the first radiating element 312 on its contact surface 316 in the corner of the bottom surface of the substrate 311. This point in the first radiating element is the shared feed point FP of the partial antennas. It is located according to the invention between the partial antennas in a so-called coupling space. The "coupling space" means in this description and claims the space substantially of the shape of a rectangular prism defined by the first heads of the substrates and extended a little to both directions in all three dimensions. "A little" means a distance which is small compared to the length and width of the substrates.

The second partial antenna 320 gets its feed through a short intermediate conductor 332, one end of which is connected to the first radiating element 312 at the first head of the first substrate 311 and other end of which is connected to the third radiating element 322 at the first head of the second substrate 321. The intermediate conductor is thus in the coupling space. The third radiating element is connected galvanically only to the intermediate conductor 332, the second partial antenna then being in this example of monopole type. The first and the second partial antenna and the intermediate conductor together constitute the dual antenna 300.

Figure 4:
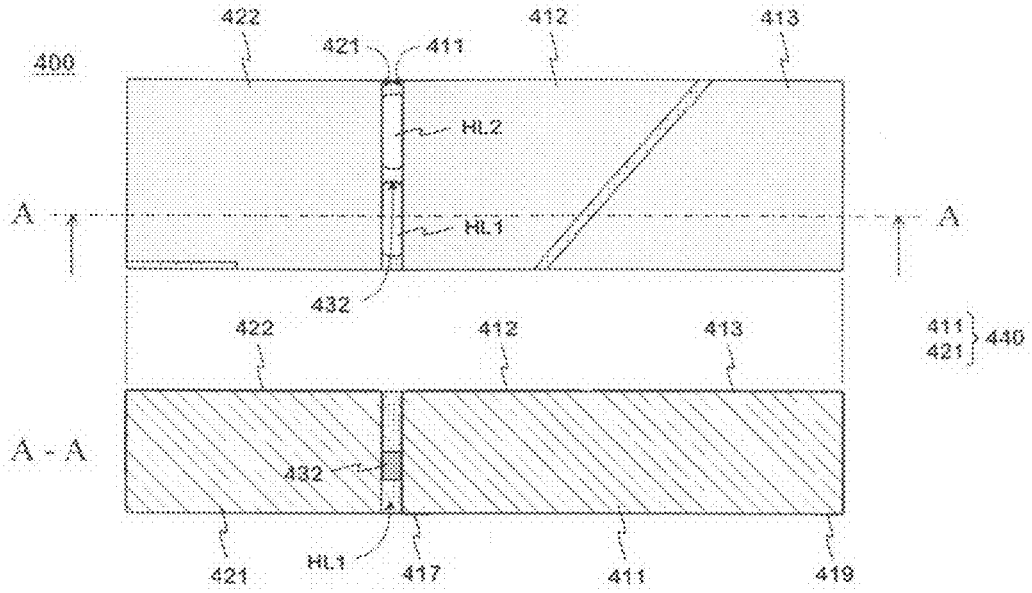
FIG. 4 shows a second example of a dielectric dual antenna according to the invention.

FIG. 4 shows a second example of a dielectric dual antenna according to the invention. The dual antenna 400 comprises the first partial antenna which includes its substrate 411, the first radiating element 412 and the second radiating element 413 and the second partial antenna which includes its substrate 421 and the third radiating element 422, as in FIG. 3. A difference to the structure shown in FIG. 3 is that said substrates 411, 421 constitute now a unitary total substrate 440. Therefore, in this case the substrates of the partial antennas are called partial substrates. The partial substrates are separated from each other with two holes HL1, HL2 extending through the substrate 440 from its top surface to its bottom surface. These holes are elongated in the cross direction of the substrate so that only three relatively narrow necks join the partial substrates to each other. For this reason, the field of both partial antennas can spread in the substrate only to a small extent to the side of the other antenna, and the electrical isolation of the partial antennas is thus relatively good.

In FIG. 4, the dual antenna 400 has been drawn from above and in the other sub-figure along a longitudinal line A-A one side cut away as far as the first hole HL1. Thus the narrow rear portion of the inner surface of the first opened hole HL1 is seen in the latter sub-figure, which rear portion joins from its one edge the first head of the first partial substrate 411 and from its other edge the first head of the second partial substrate 421. These heads are coated with conductive material so that the first radiating element 412 extends via holes HL1 and HL2 on the bottom surface of the substrate, and the third radiating element 422 extends via the opposing surfaces of the same holes to a certain distance from the bottom surface of the substrate. The afore-mentioned rear portion of the inner surface of the first hole HL1 is partially coated with conductive material. This conductive coating 432 connects the third radiating element to the first radiating element thus functioning as the intermediate conductor feeding the second partial antenna. The intermediate conductor 432 is in the coupling space of the antenna 400. The intermediate conductor could also be on the top surface of the substrate 411 between the holes HL1 and HL2.

The sectional drawing of FIG. 4 shows a contact surface 417 being the one further back of the contact surfaces of the first radiating element 412 on the bottom surface of the substrate. This can be connected either to the feed conductor of the antenna or the signal ground. Likewise is seen a contact surface 419 being the one further back of the contact surfaces of the parasitic second radiating element 413, which contact surface is connected to the signal ground.

Figure 5:
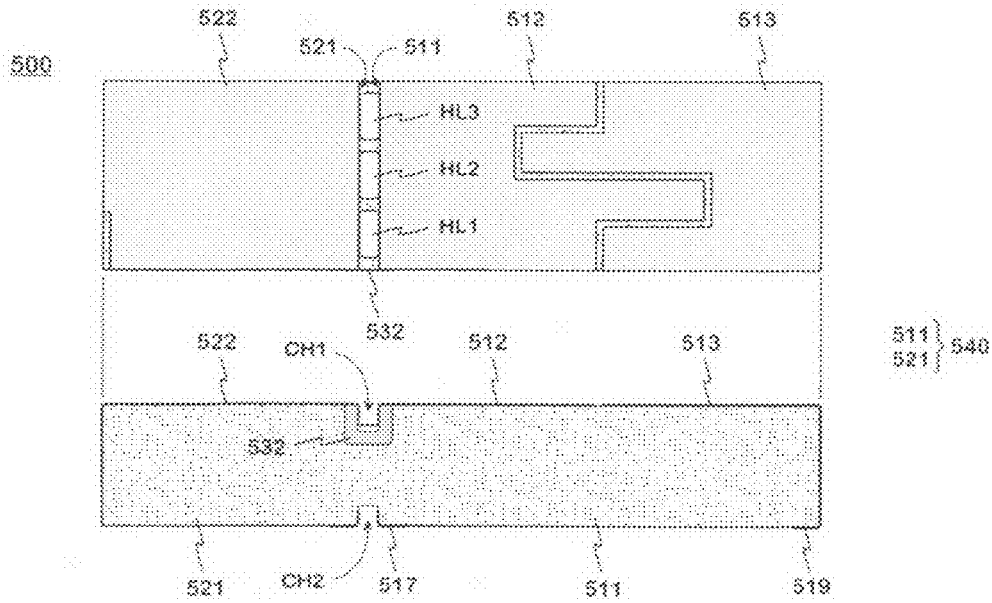
FIG. 5 shows a third example of a dielectric dual antenna according to the invention.

FIG. 5 shows a third example of a dielectric dual antenna according to the invention. The dual antenna 500 has been drawn both from above and sideways. It comprises the first partial antenna which includes its substrate 511, the first radiating element 512 and the second radiating element 513 and the second partial antenna which includes its substrate 521 and the third radiating element 522, as in previous figures. The substrate of the first partial antenna, or the first partial substrate 511 and the substrate of the second partial antenna, or the second partial substrate 521, constitute a unitary total substrate 540, as in FIG. 4. The partial substrates are in this case separated from each other by three holes HL1, HL2, HL3 extending vertically through the substrate 540 and by two grooves CH1, CH2. The first groove CH1 is at the holes downwards from the top surface of the substrate and the second groove CH2 is at the holes upwards from the bottom surface of the substrate. Thus, four relatively narrow necks, the height of which is notably smaller than the height of the substrate, remain to connect the partial substrates. In this way, the electrical isolation of the partial antennas is arranged relatively good.

A most notable difference to the structure shown in FIG. 4 is that an intermediate conductor 532 feeding the second partial antenna is now on one side surface of the substrate 540. This side surface is coated with conductor so that the opposing ends of the first radiating element 512 and the third radiating element 522 become coupled to each other. In this case, the intermediate conductor 532 has to go round the end of the first groove thus forming a U-shaped bend.

The feed point FP of the dual antenna 500 is also in this case on the bottom surface of the substrate 540 on the side of the first partial substrate 511 in the coupling space of the antenna. The feed point is connected galvanically to the part of the first radiating element 512 on the top surface of the substrate via the conductive coating of the first hole HL1.

Figure 6:
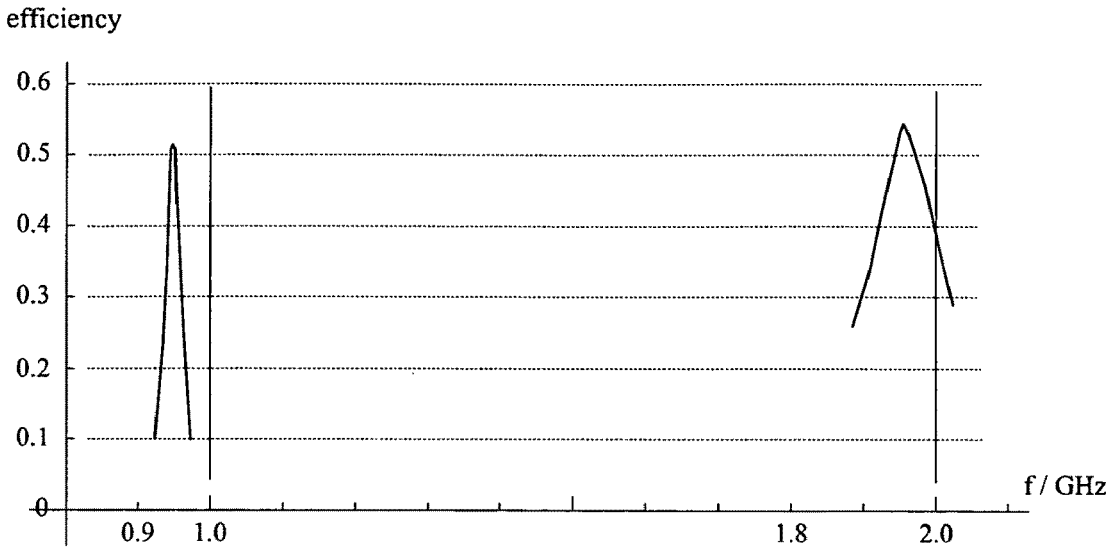
FIG. 6 shows an example of the efficiency of an antenna according to the invention.

FIG. 6 shows an example of the efficiency of an antenna according to FIG. 3. The curve shows the efficiency as a function of frequency. The lower operating band of the antenna is tuned to the receive band of the GSM900 (Global System for Mobile communications) system and the upper operating band to the receive band of the GSM1900 system. It is seen that the efficiency in the lower band is on average about 0.35 and in the upper band about 0.45. Thus, the efficiency is good especially in the upper band considering the small size of the antenna.

In this description and claims a "partial antenna" means a pure chip component, which comprises radiators, or a portion of it. Correspondingly, an "antenna" means the combination of "partial antennas". Functionally, the antenna also comprises the ground arrangement around the chip component(s). Prefixes "bottom", "top", "horizontal" and "vertical" and epithets "below", "above" and "from above" refer to the position of the antenna in which it is mounted on the top surface of a horizontal circuit board. The operating position of the antenna can naturally be whichever.

An antenna according to the invention can naturally differ in its details from the ones described. For example, the feed conductor of the antenna can be connected to the partial antenna corresponding to the upper operating band instead of the partial antenna corresponding to the lower operating band. The location of the intermediate conductor connecting partial antennas to each other can vary in the coupling space of the antenna. The partial antenna corresponding to the lower operating band can comprise only one radiator instead of two, and the partial antenna corresponding to the upper operating band can comprise two radiators instead of one. In addition to its feed point, an individual radiator can also be connected to the ground. If the antenna has a unitary substrate, the number and shape of the holes separating the partial substrates can vary. They can also lead horizontally through the substrate. In addition to holes or instead of them, there can be grooves separating partial substrates. The intermediate conductor connecting the partial antennas to each other can be on the surface of a hole or a groove or on the outer surface of the entire substrate irrespective of how the reduction of the substrate material improving the electrical isolation of the partial antennas has been implemented. Manufacturing an antenna according to the invention can be implemented e.g. by coating a ceramic chip partially with a conductor or by growing a metal layer on the surface of e.g. silicon and removing a portion of it with a technology used in manufacturing of semiconductor devices. The inventive idea can be applied in different ways within the limitations set by the independent claim 1.

The invention claimed is:

1. A method of operating a dual antenna capable of operating in first and second frequency bands the antenna comprising a first radiating element disposed on a first substrate, a second radiating element disposed on a second substrate, a feed point common to both said first and second radiating elements, and an intermediate conductor disposed between said first radiating element and said second radiating element, said dual antenna being disposed on an external substrate different from said first or second substrates, the method comprising:

placing a conductive trace on said external substrate in signal communication with the feed point of the dual antenna; and operating said dual antenna within said first and second bands.

2. The method of claim 1, further comprising tuning said first and second radiating elements substantially independent of one another.

3. The method of claim 2, wherein said substantially independent tuning of the first and second radiating elements is provided at least in part by the intermediate conductor.

4. The method of claim 3, further comprising providing electrical isolation between said first and second radiating elements, said isolation provided at least in part by use of said first substrate and said second substrate, the first and second substrates being substantially detached from one another.

5. The method of claim 2, further comprising providing electrical isolation between said first and second radiating elements, said isolation provided at least in part by the first and second substrates, the first and second substrates comprising a unitary substrate having material removed at least partly between the first and second radiating elements, said removed material enhancing said electrical isolation between said first and second radiating elements.

6. A dual antenna comprising:

a first partial antenna to implement a lower operating band of the antenna; and a second partial antenna to implement an upper operating band;

wherein both partial antennas comprise a respective dielectric substrate and as its conductive coating at least one radiating element, wherein both substrates have a first and a second head, a top, a bottom and a plurality of side surfaces the direction of the plurality of side surfaces normal of the heads being the longitudinal direction of the substrate; and wherein the substrates of the partial antennas are located their first heads face to face, they have substantially the same longitudinal direction, and the partial antennas have a shared feed point in a coupling space defined by the first heads at the end of the radiating element on the side of the first head of the substrate of one partial antenna, and the other partial antenna gets its feed through an intermediate conductor which extends in said coupling space from last-mentioned radiating element to a radiating element of the latter partial antenna.

7. The dual antenna of claim 6, wherein the shared feed point is in a radiating element of the first partial antenna.

8. The dual antenna of claim 6, wherein the substrate of the first partial antenna and the substrate of the second partial antenna are detached, and said intermediate conductor is a separate conductor connected to a radiator of the first partial antenna and a radiator of the second partial antenna.

9. The dual antenna of claim 6, wherein the substrate of the first partial antenna and the substrate of the second partial antenna constitute a unitary total substrate, where substrate material has been reduced between the partial antennas for improving their electrical isolation.

10. The dual antenna of claim 9, wherein the substrate material has been reduced so that at least one hole leads through the substrate.

11. The dual antenna of claim 9, wherein the substrate material has been reduced so that there is at least one groove in the substrate.

12. The dual antenna of claim 9, wherein the intermediate conductor is a conductive coating on a side surface of the substrate extending from a radiator of the first partial antenna to a radiator of the second partial antenna.

13. The dual antenna of claim 6, wherein the intermediate conductor is a conductive coating on inner surface of said type of hole, the coating extending from the radiator of the first partial antenna to the radiator of the second partial antenna.

14. The dual antenna of claim 6, wherein the first partial antenna comprises a first radiating element which covers one part of the top surface of its substrate and at least a part of the first head of its substrate, and a second radiating element which covers another part of the top surface of the substrate in question and at least a part of the other head of the substrate, which radiating elements extend via the heads of the substrate on the side of the bottom surface of the substrate to form said feed point and a ground point to the first radiating element and to form at least one ground point to the second radiating element.

15. The dual antenna of claim 6, wherein the substrates comprise a ceramic material.

16. A dual antenna configured to be disposed on an external substrate, the antenna comprising:

a first radiating element disposed on a first substrate;

a second radiating element disposed on a second substrate;

a feed point common to both said first and second radiating elements;

an intermediate conductor disposed between said first radiating element and said second radiating element; and a conductive trace on said external substrate electrically coupled with the feed point;

wherein said intermediate conductor is configured to tune the first radiating element independently from the second radiating element, said tuning being effected without the use of discrete matching components.

17. A dual antenna, comprising:

a first radiating element disposed on a first portion of a first substrate;

a second radiating element disposed on a second portion of a second substrate;

a feed point common to both said first and second radiating elements; and an intermediate conductor disposed between said first radiating element and said second radiating element;

wherein:

the first and second substrates are part of a unitary substrate; and at least a portion of the unitary substrate between the first and second radiating elements is free from conductive material so as to electrically isolate the first radiating element from the second radiating element.

18. The dual antenna of claim 17, wherein said feed point common to both said first and second radiating elements is disposed on the first radiating element.

19. The dual antenna of claim 17, wherein the first substrate and the second substrate are substantially detached from one another along at least one dimension.

20. The dual antenna of claim 17, wherein the intermediate conductor comprises a conductive coating on a surface of the unitary substrate, said intermediate conductor extending from the first radiating element to the second radiating element.

21. The dual antenna of claim 17, wherein the intermediate conductor comprises a conductive coating disposed on an inner surface of a hole formed in said unitary substrate, the conductive coating extending from the first radiating element to the second radiating element.

22. The dual antenna of claim 17, wherein each of the first and the second substrate comprise a ceramic material.

23. A dual antenna, comprising:

a first radiating element disposed on a first substrate;

a second radiating element disposed on a second substrate;

a feed point common to both said first and second radiating elements; and an intermediate conductor disposed between said first radiating element and said second radiating element;

wherein:

the first and second substrates comprise a unitary substrate; and the intermediate conductor comprises a conductive coating on a surface of the unitary substrate, said intermediate conductor extending from the first radiating element to the second radiating element.

24. The dual antenna of claim 23, wherein said feed point common to both said first and second radiating elements is disposed on the first radiating element.

25. The dual antenna of claim 23, wherein the first substrate and the second substrate are substantially detached from one another along at least one dimension.

26. A dual antenna, comprising:

a first radiating element disposed on a first substrate;

a second radiating element disposed on a second substrate;

a feed point common to both said first and second radiating elements; and an intermediate conductor disposed between said first radiating element and said second radiating element;

wherein the first and second substrates comprise a unitary substrate; and the intermediate conductor comprises a conductive coating disposed on an inner surface of a hole formed in said unitary substrate, the conductive coating extending from the first radiating element to the second radiating element.

27. The dual antenna of claim 26, wherein said feed point common to both said first and second radiating elements is disposed on the first radiating element.

28. The dual antenna of claim 26, wherein the first substrate and the second substrate are substantially detached from one another along at least one dimension.

* * * * *